US007666128B2

(12) United States Patent
Hubbard et al.

(10) Patent No.: US 7,666,128 B2
(45) Date of Patent: Feb. 23, 2010

(54) BOARD SPORT TRAINING APPARATUS

(76) Inventors: James Humphrey Hubbard, 2926 Via Pepita, Carlsbad, CA (US) 92009; Darci Ruth Raphael, 2251 Domingo Rd., Fullerton, CA (US) 92835

( * ) Notice: Subject to any disclaimer, the term of this patent is extended or adjusted under 35 U.S.C. 154(b) by 0 days.

(21) Appl. No.: 12/248,908

(22) Filed: Oct. 10, 2008

(65) Prior Publication Data

US 2009/0105048 A1 Apr. 23, 2009

Related U.S. Application Data

(60) Provisional application No. 60/981,409, filed on Oct. 19, 2007.

(51) Int. Cl.
*A63B 22/04* (2006.01)
*A63B 23/00* (2006.01)

(52) U.S. Cl. ..... 482/148; 482/52

(58) Field of Classification Search ..... 482/51, 482/52, 148, 142, 146; 297/338, 423.41
See application file for complete search history.

(56) References Cited

U.S. PATENT DOCUMENTS 5,269,735 A * 12/1993 Pfitzenmeier ..... 482/52
5,509,871 A 4/1996 Giovanni
5,540,638 A * 7/1996 Wilkinson ..... 482/52
5,634,687 A * 6/1997 Gamble ..... 297/338
5,904,636 A 5/1999 Chen
6,053,824 A * 4/2000 Boudreaux ..... 473/440
6,132,338 A * 10/2000 Shifferaw ..... 482/30
6,367,874 B2 * 4/2002 Casini ..... 297/118
6,450,923 B1 * 9/2002 Vatti ..... 482/8
6,454,357 B1 * 9/2002 Foulger ..... 297/423.41
6,524,355 B1 * 2/2003 Jenkins ..... 48/52
6,916,276 B1 7/2005 Robinson
7,300,392 B1 11/2007 Curran
7,355,134 B1 * 4/2008 Anderson ..... 200/85 R
7,465,263 B1 * 12/2008 Conrad et al. ..... 482/148
7,520,840 B2 * 4/2009 Shifferaw ..... 482/52
2008/0096183 A1 * 4/2008 Cotran et al. ..... 434/428
2009/0042697 A1 * 2/2009 Bartley ..... 482/51
2009/0048074 A1 * 2/2009 Kamins ..... 482/52

* cited by examiner

*Primary Examiner*—Steve R Crow
(74) *Attorney, Agent, or Firm*—Ash Tankha

(57) ABSTRACT

Disclosed herein is a portable apparatus for training a user in in increasing levels of skill, control and maneuverability of a board for a board sport. The portable apparatus comprises a foot placement mat and a support unit. The foot placement mat comprises multiple placement zones for indicating a first location for positioning a support unit and second locations for placing the user's feet. The support unit comprises laterally opposite support members and hand placement platforms. Each of the laterally opposite support members comprises an elongated section and a lower protruding section. The hand placement platforms are detachably attached to the elongated section or the lower protruding section of the laterally opposite support members for enabling placement of the user's hands in an elevated position or a lower position respectively. The support unit positioned on the foot placement mat enables the training of the user in increasing levels of skill, control and maneuverability of a board for a board sport.

7 Claims, 17 Drawing Sheets

BOARD SPORT TRAINING APPARATUS

CROSS REFERENCE TO RELATED APPLICATIONS

This application claims the benefit of provisional patent application No. 60/981,409 titled "Multi-Level Surfing "Pop-Up" (initial standing-up) Practice Unit", filed on Oct. 19, 2007 in the United States Patent and Trademark Office.

BACKGROUND

This invention, in general, relates to a training apparatus. More particularly, this invention relates to an apparatus for training a user in increasing levels of skill, control and maneuverability of a board for a board sport.

Board sports for example, surfing, wind surfing, snowboarding, skateboarding, etc. are sports that are played with a board as a primary equipment. Board sports are classified as action sports or extreme sports that require skill and technique. A user attains a degree of proficiency in the board sports only after a few trial sessions. The user needs a training apparatus that allows improvement of the user's board sporting skills and techniques related to the board sports. Moreover, the user needs a training apparatus that enables the user to simulate body actions corresponding to movements made by a person accomplished in the board sports. Typical board mounting techniques and practice methods require the user to lie on a floor which is uncomfortable to the user and is not amenable to the development of good board mounting techniques. Also, practicing boarding mounting techniques on training equipment not ergonomically designed for board sporting may result in the user losing balance and falling and therefore proves to be ineffective. Furthermore, inadequate room on the training equipment for positioning the user's feet may result in incorrect positioning of the user's feet while practicing board mounting techniques.

Hence, there is an unmet need for a portable apparatus that trains a user in increasing levels of skill, control and maneuverability of a board for a board sport and provides an increased rate of learning and comfort to the user. Moreover, there is a need for a portable apparatus that aids in increasing board sporting skills and control of a board of the board sport.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The portable apparatus disclosed herein addresses the above stated need for training a user in increasing levels of skill, control and maneuverability of a board for a board sport and for providing an increased rate of learning and comfort to the user. The portable apparatus comprises a support unit and a foot placement mat. The foot placement mat comprises multiple placement zones. The placement zones indicate a first location for positioning the support unit and second locations for placing the user's feet.

The support unit comprises laterally opposite support members and multiple hand placement platforms. Each of the laterally opposite support members comprises an elongated section and a lower protruding section for supporting opposite ends of the hand placement platforms. The hand placement platforms may be detachably attached to the elongated section and the lower protruding section of the laterally opposite support members for enabling placement of the user's hands in an elevated position and a lower position respectively. The hand placement platforms may also be attached or glued to the elongated section and the lower protruding section of the laterally opposite support members. The hand support platforms are positioned horizontally and perpendicularly to the laterally opposite support members.

The elongated section of the laterally opposite support members is positioned perpendicular to the foot placement mat, and the lower protruding section of the laterally opposite support members is positioned parallel to the foot placement mat for enabling the user to place hands on one of the hand placement platforms in the elevated position for training in one of the difficulty levels of the board sport. The elongated section of the laterally opposite support members is positioned parallel to the foot placement mat, and the lower protruding section of the laterally opposite support members is positioned perpendicular to the foot placement mat for enabling the user to place hands on one of the hand placement platforms in the lower position for training in one of the other difficulty levels of the board sport.

The support unit is positioned at the indicated first location on the foot placement mat. The user positions the elongated section and the lower protruding section of the laterally opposite support members in a parallel direction or a perpendicular direction on the foot placement mat based on the user's training requirements, user's experience, user's skill, and the user's comfort level. Prior to mounting the foot placement mat, the user places hands on one of the hand placement platforms detachably attached to the elongated section or the lower protruding section of the laterally opposite support members in the elevated position or the lower position, to position the user's body in a prone body position. The user then mounts the foot placement mat from the prone position by placing his feet at the indicated second locations on the foot placement mat and simultaneously withdraws his hands from the hand placement platform.

The user maintains a predefined body alignment and standing maneuver on the foot placement mat corresponding to the board mounting techniques of the board sport after mounting the foot placement mat. The user repeats the mounting on the foot placement mat from the prone position with simultaneous withdrawal of the hands from the hand placement platforms for practicing board mounting techniques. The hand placement platforms comprise a contoured profile to facilitate the user to rest the user's shin against the contoured profile when the user mounts the foot placement mat at the indicated second locations.

The support unit in the elevated position or the lower position houses the toes of the user's feet when the user mounts the foot placement mat at one of the indicated second locations. The portable apparatus further comprises a chest elevation pad detachably placed on each of the hand placement platforms for enabling the user to increase the elevation of the user's upper body. The chest elevation pad elevates the upper body corresponding to the increased elevation.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1A:
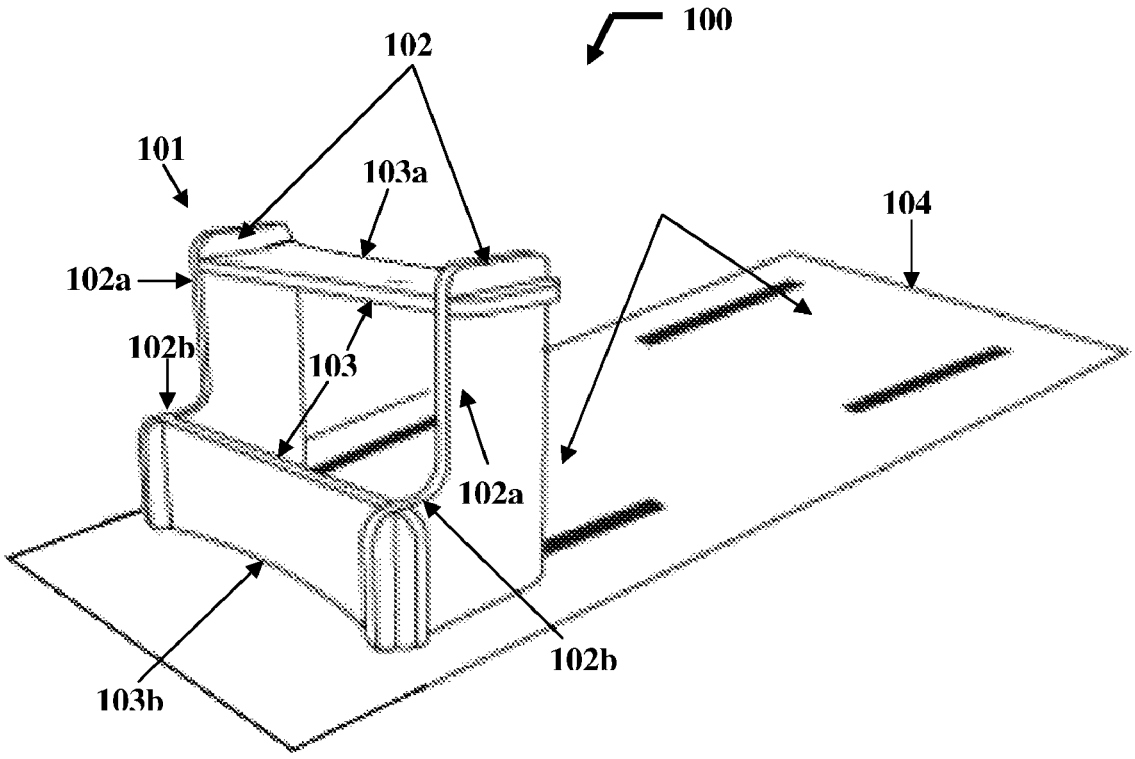
FIGS. 1A-1B exemplarily illustrate a portable apparatus for training a user in different difficulty levels of a board sport.
Figure 1B:
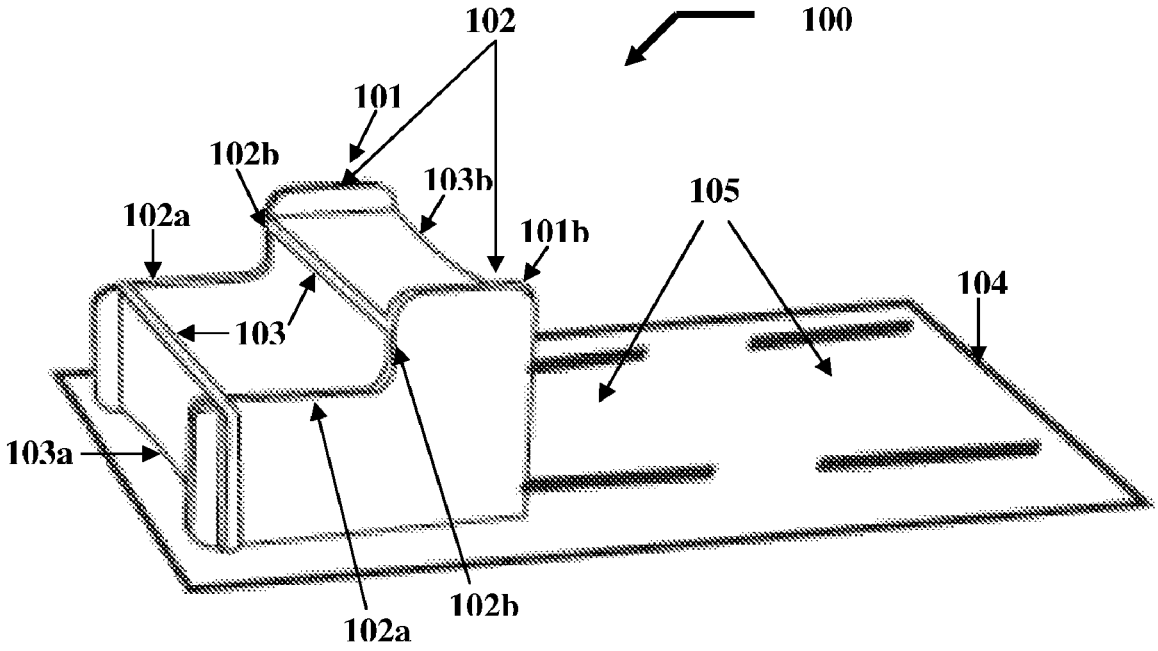
Figure 7:
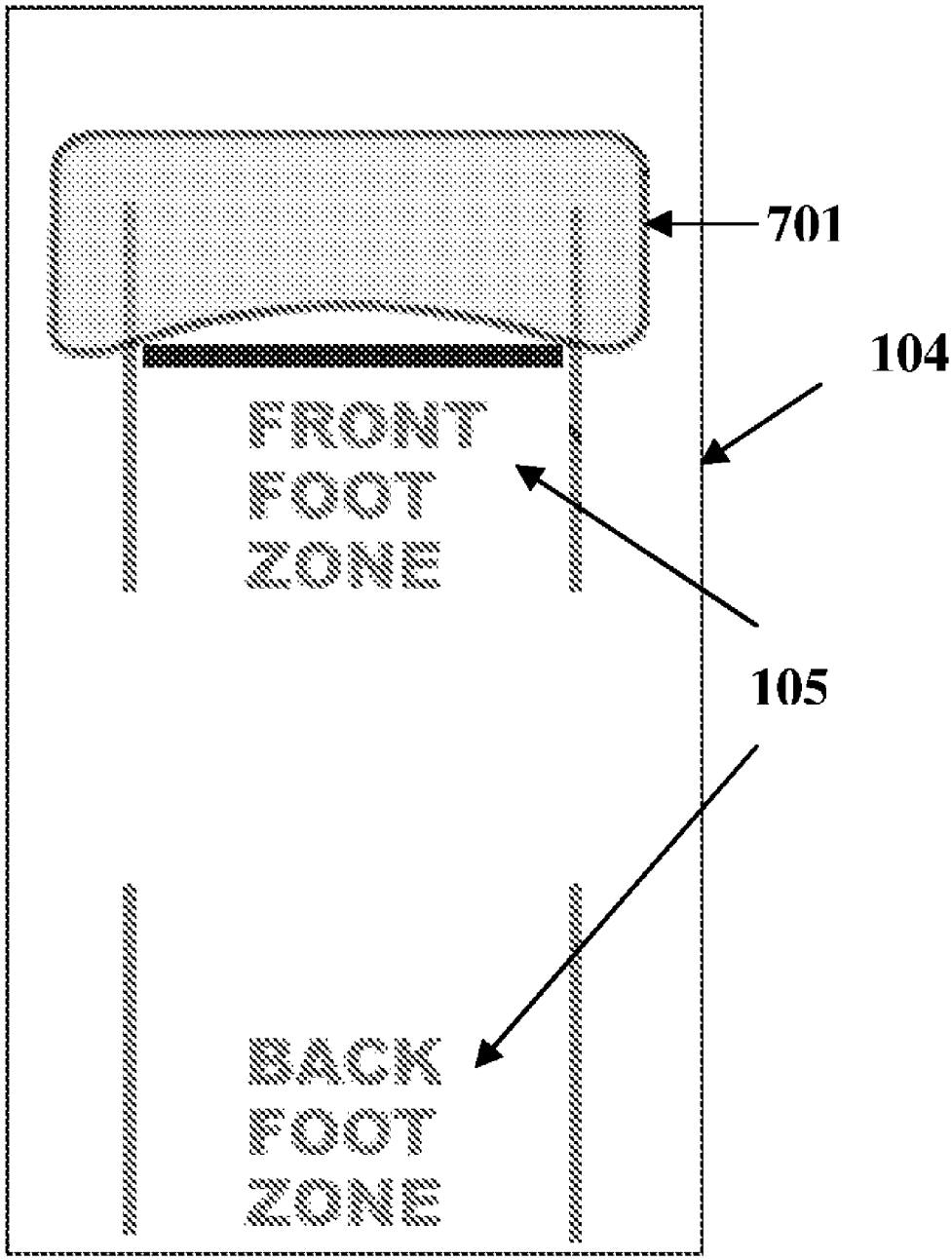
FIG. 7 exemplarily illustrates a foot placement mat of the portable apparatus with placement zones for indicating second locations for placing feet of the user.

FIGS. 1A-1B exemplarily illustrate a portable apparatus 100 for training a user 1101 in increasing levels of skill, control and maneuverability of a board for a board sport. The board sports may, for example, comprise windsurfing, snowboarding, skateboarding, surfing, etc. The portable apparatus 100 comprises a foot placement mat 104 and a support unit 101. The foot placement mat 104 comprises multiple placement zones. The placement zones indicate a first location 701 for positioning the support unit 101 and second locations 105 for placing the user's 1101 feet. The indicated second locations 105 may, for example, comprise a "Front Foot Zone" for placing the user's 1101 front foot and a "Back Foot Zone" for placing the user's 1101 back foot as illustrated in FIG. 7.

The support unit 101 comprises multiple laterally opposite support members 102 and multiple hand placement platforms 103. Each of the laterally opposite support members 102 comprises an elongated section 102*a* and a lower protruding section 102*b*. The elongated section 102*a* and the lower protruding section 102*b* support opposite ends of the hand placement platforms 103. The elongated section 102*a* and the lower protruding section 102*b* may, for example, comprise interlocking slots 301 for inserting the opposite ends of the hand placement platforms 103. The laterally opposite support members 102 with the elongated section 102*a* and the lower protruding section 102*b* may, for example, resemble "L" shaped members. A side view of one of the laterally opposite support members 102 of the support unit 101 is exemplarily illustrated in FIG. 3.

The hand placement platforms 103 are detachably attached to the elongated section 102*a* and the lower protruding section 102*b* of the laterally opposite support members 102 for enabling placement of the user's 1101 hands in an elevated position and a lower position respectively. The hand placement platforms 103 may also be attached or glued to the elongated section 102*a* and the lower protruding section 102*b* of the laterally opposite support members 102. A top view of one of the hand placement platforms 103 of the support unit 101 is exemplarily illustrated in FIG. 4. The support unit 101 is positioned at the indicated first location 701 on the foot placement mat 104.

Figure 3:
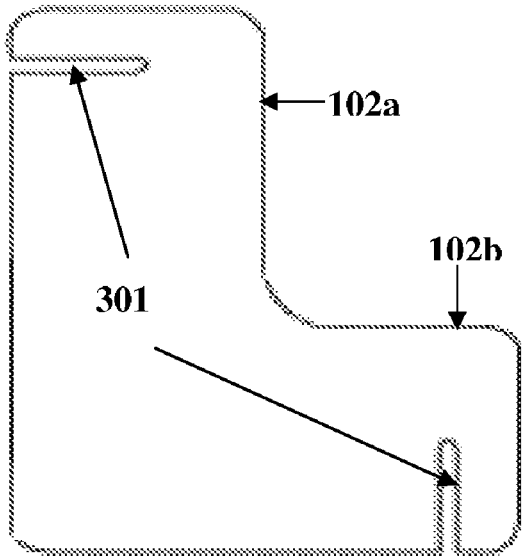
FIG. 3 exemplarily illustrates a side view of one of the laterally opposite support members of the support unit.
Figure 4:
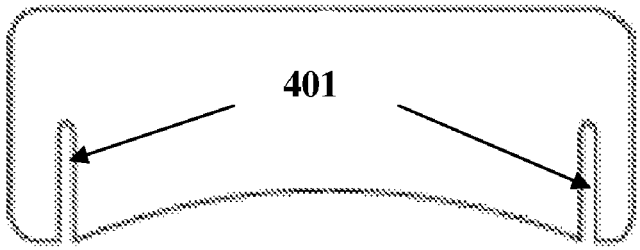
FIG. 4 exemplarily illustrates a top view of one of the hand placement support members of the support unit.
Figure 6:
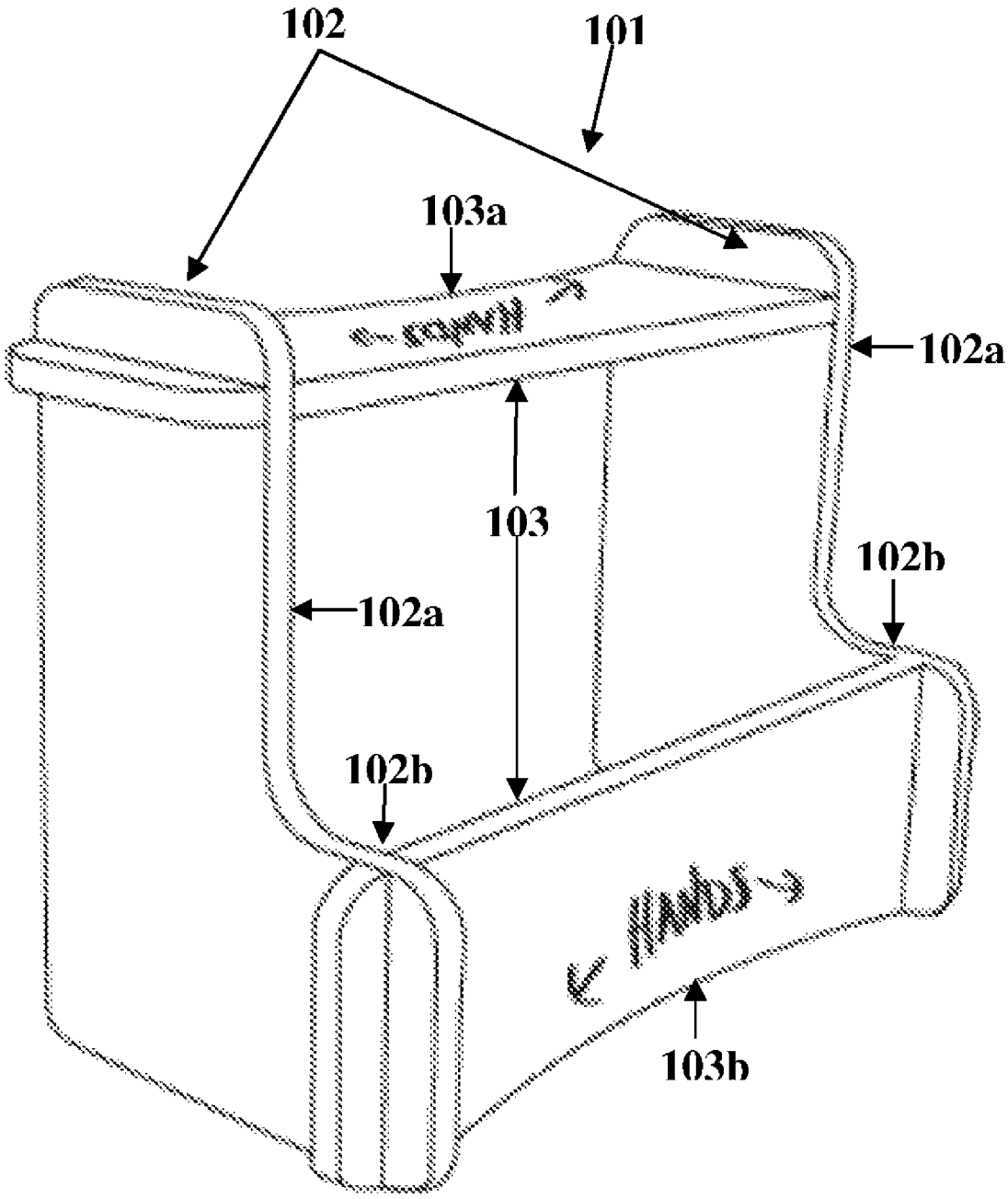
FIG. 6 exemplarily illustrates indications of locations for placing the user's hands on the hand placement platforms of the support unit.

The hand placement platforms 103 may also indicate where the user's 1101 hands are to be positioned on the hand placement platforms 103 of the support unit 101 as illustrated in FIG. 6. The hand placement platforms 103 are positioned horizontally and perpendicularly to the laterally opposite support members 102. Interlocking slots 301 and 401 may be provided on the laterally opposite support members 102 and the hand placement platforms 103 respectively as illustrated in FIGS. 3-4. The hand placement platforms 103 are detachably attached to the laterally opposite support members 102 through the interlocking slots 301 and 401.

Figure 8A:
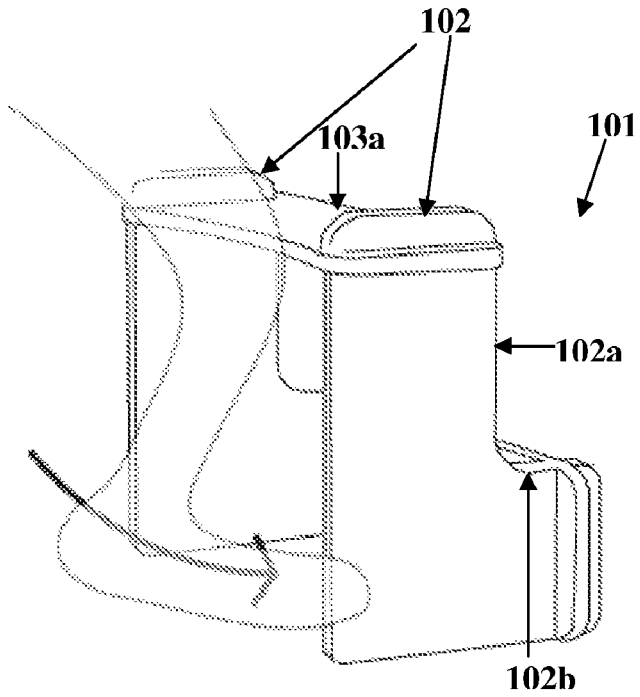
FIGS. 8A-8B exemplarily illustrate the contoured profile of the hand placement platforms of the support unit and provision for positioning the feet, shin, and toes of a user.
Figure 8B:
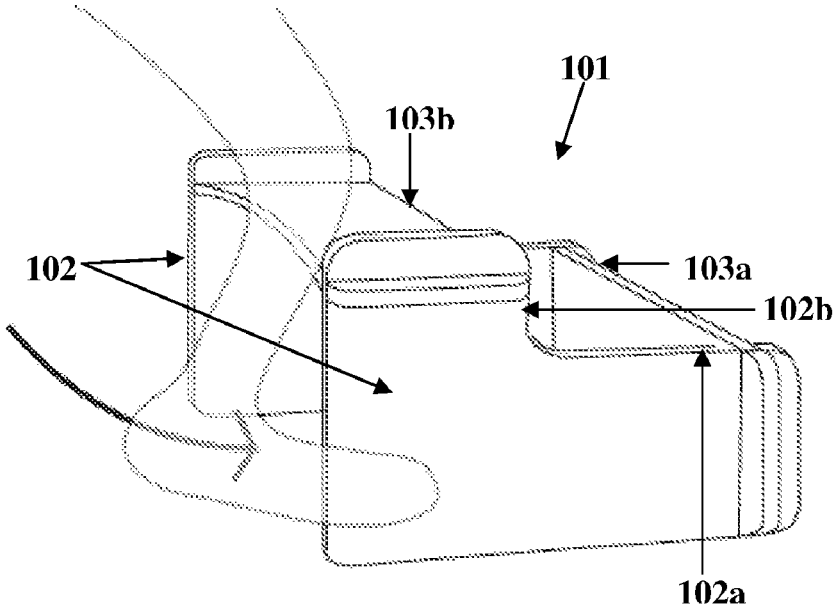

The hand placement platforms 103 comprise a contoured profile for resting the user's 1101 shin when the user 1101 mounts the foot placement mat 104 by placing his feet at the indicated second locations 105. The support unit 101 houses the toes of the user's 1101 feet when the user 1101 mounts the foot placement mat 104 at one of the indicated second locations 105. The support unit 101 is designed to provide a "toe cave" feature as illustrated in FIGS. 8A-8B. The "toe cave" feature of the support unit 101 houses the toes of the user's 1101 feet. The contoured profile of the hand placement platforms 103 of the support unit 101 and provision for positioning the user's 1101 feet, shin, and toes is illustrated in FIGS. 8A-8B.

The support unit 101 when positioned on the foot placement mat 104 enables the user to train 1101 in increasing levels of skill, control and maneuverability of a board for a board sport. The elongated section 102*a* of the laterally opposite support members 102 is positioned perpendicular to the foot placement mat 104 and the lower protruding section 102*b* of the laterally opposite support members 102 is positioned parallel to the foot placement mat 104 for enabling the user 1101 to place hands on the hand placement platform 103*a* in the elevated position for training in one of the skill levels of the board sport, for example, the beginner's level. The support unit 101 of the portable apparatus 100 used in the elevated position for training at the beginner's level is exemplarily illustrated in FIG. 2A.

The elongated section 102*a* of the laterally opposite support members 102 is positioned parallel to the foot placement mat 104 and the lower protruding section 102*b* of the laterally opposite support members 102 is positioned perpendicular to the foot placement mat 104 for enabling the user 1101 to place his hands on the hand placement platform 103*b* in the lower position for training in one of the difficulty levels of the board sport, for example, the advanced level. The support unit 101 of the portable apparatus 100 used in the lower position for training in an advanced level is exemplarily illustrated in FIG. 2B.

Figure 2A:
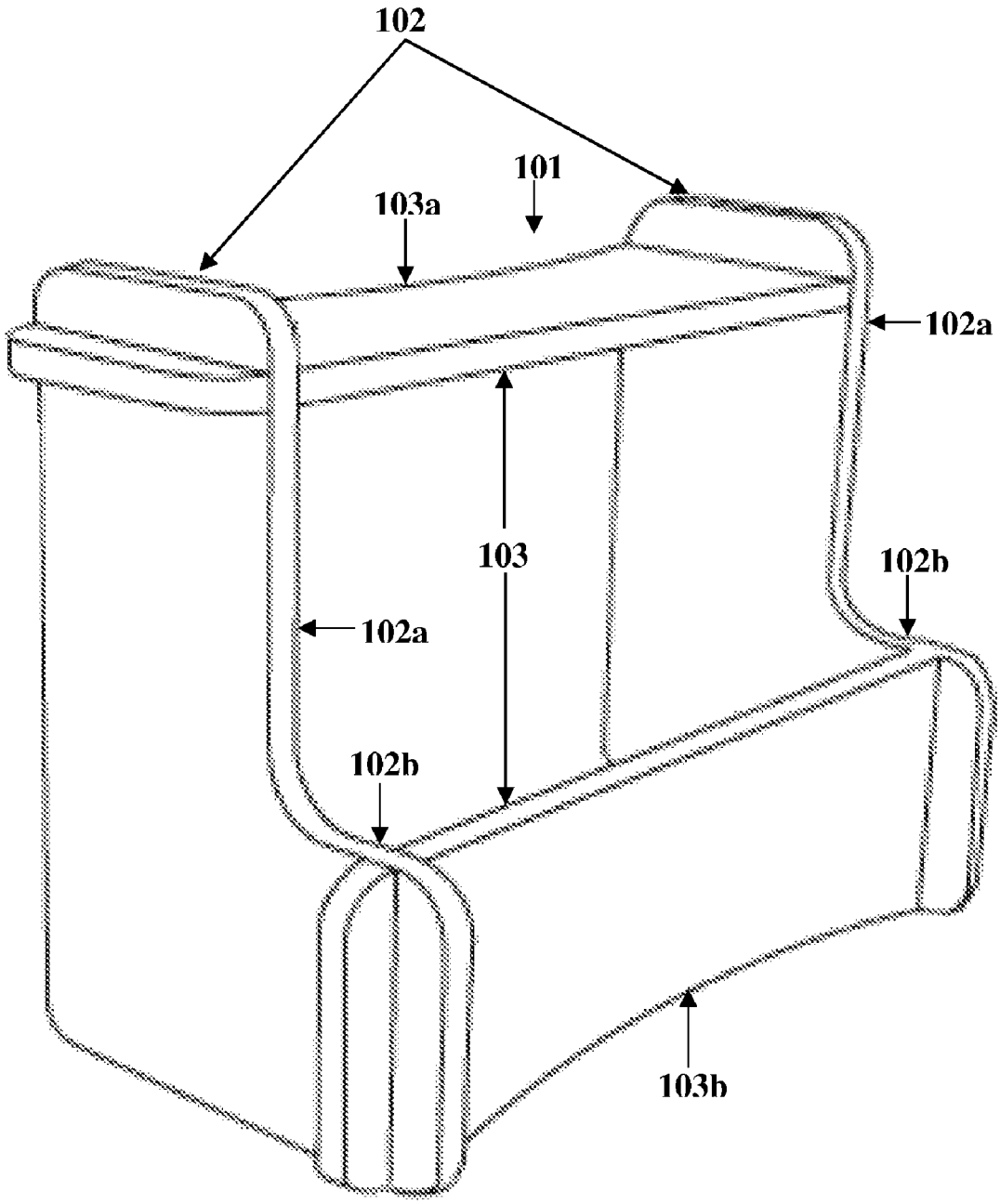
FIGS. 2A-2B exemplarily illustrate a support unit of the portable apparatus used in an elevated position and a lower position respectively.
Figure 2B:
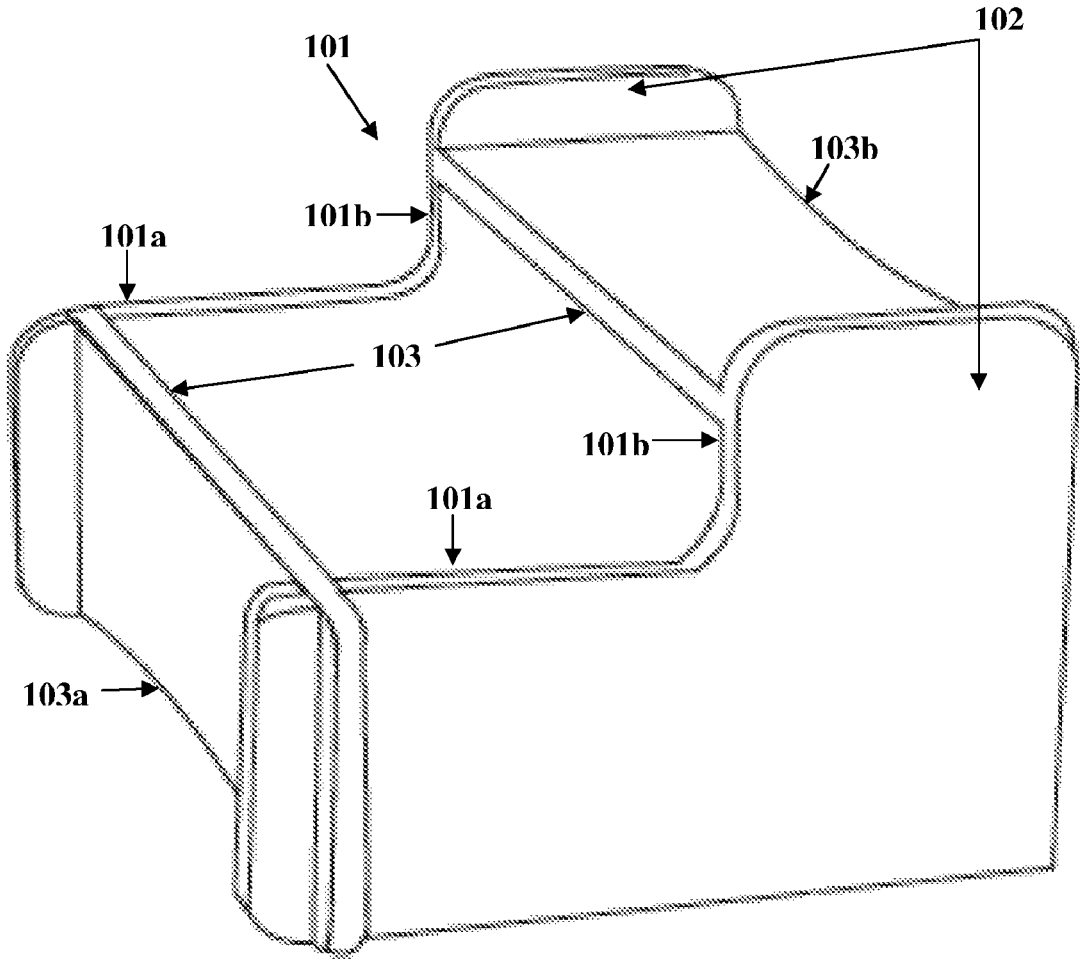
Figure 5:
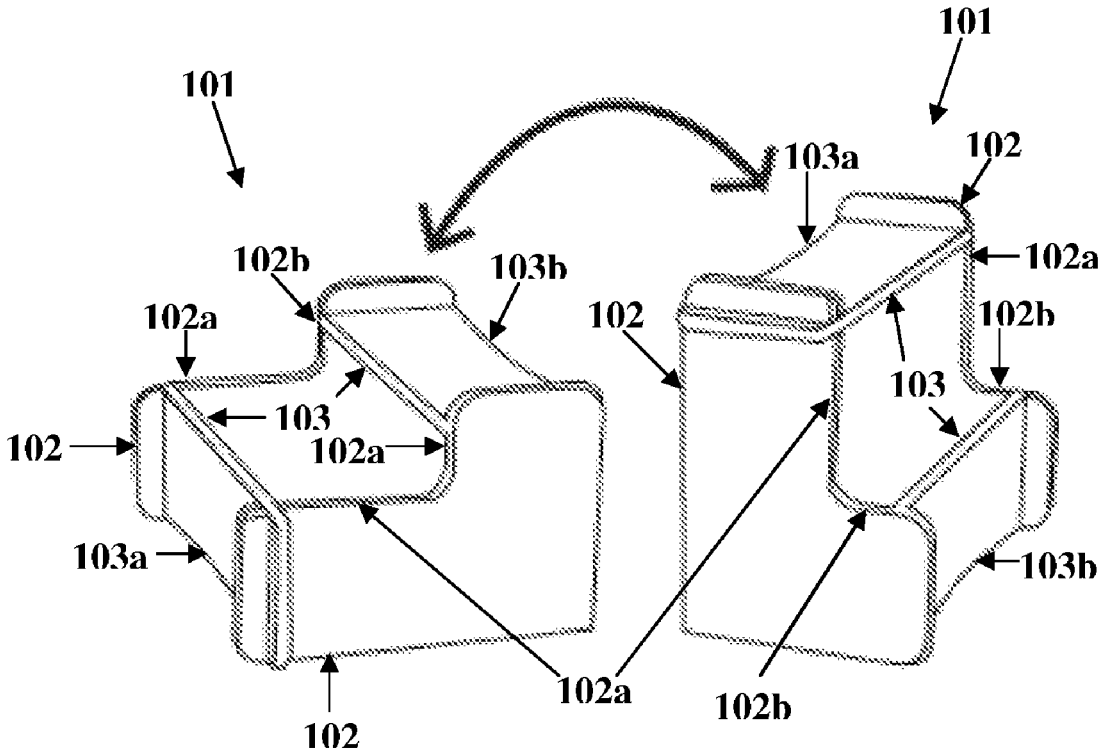
FIG. 5 exemplarily illustrates the interchangeable use of the support unit.

The user 1101 positions the elongated section 102*a* or the lower protruding section 102*b* of the laterally opposite support members 102 in a parallel direction, or a perpendicular direction on the foot placement mat 104 based, for example, on the user's 1101 training requirements, the user's 1101 experience, the user's 1101 skill, and the user's 1101 comfort level. For example, the support unit 101 may be used in the elevated position to aid training for beginners. The support unit 101 may be used in the lower position to provide training for advanced users. The support unit 101 used in the lower position as illustrated in FIG. 2B provide training in a skill set different than practice on the support unit 101 in the elevated position as illustrated in FIG. 2A. The use of the support unit 101 may be interchanged from the lower position to the elevated position and from the elevated position to the lower position as illustrated in FIG. 5.

Figure 9A:
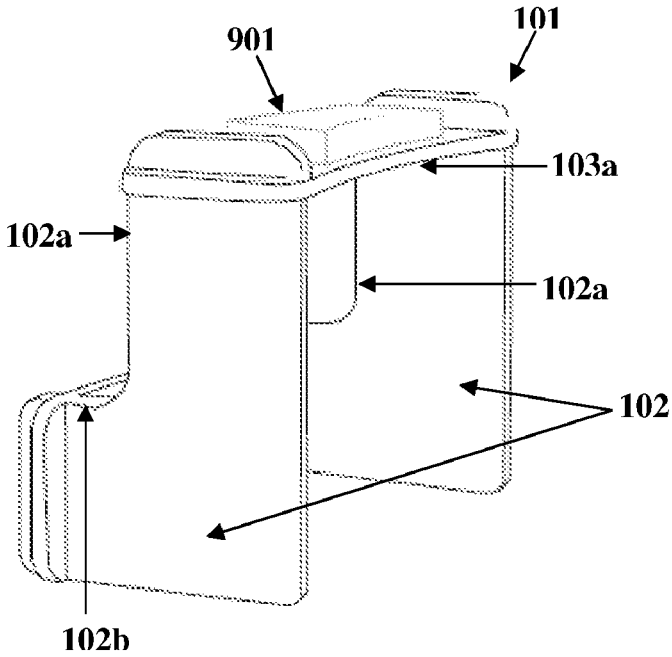
FIGS. 9A-9B exemplarily illustrate a chest elevation pad detachably placed on each of the hand placement platforms of a support unit for increasing elevation of the user's upper body.
Figure 9B:
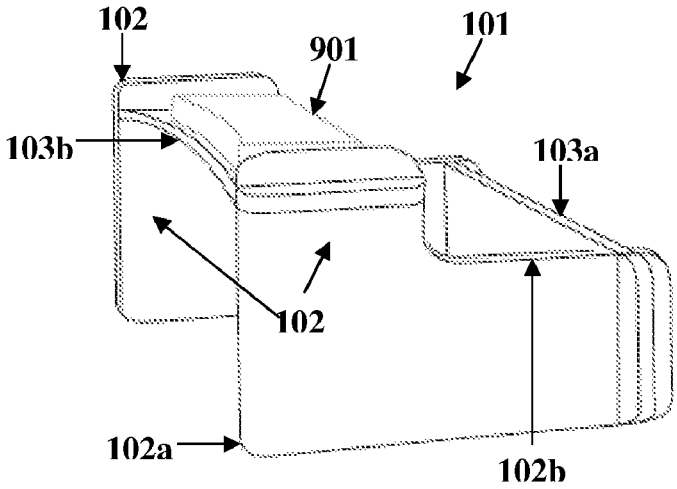

The portable apparatus 100 further comprises a chest elevation pad 901 detachably placed on each of the hand placement platforms 103, as illustrated in FIGS. 9A-9B, for enabling the user 1101 to increase elevation of the user's 1101 upper body. The chest elevation pad 901 elevates the user's 1101 upper body corresponding to the increased elevation.

Figure 10:
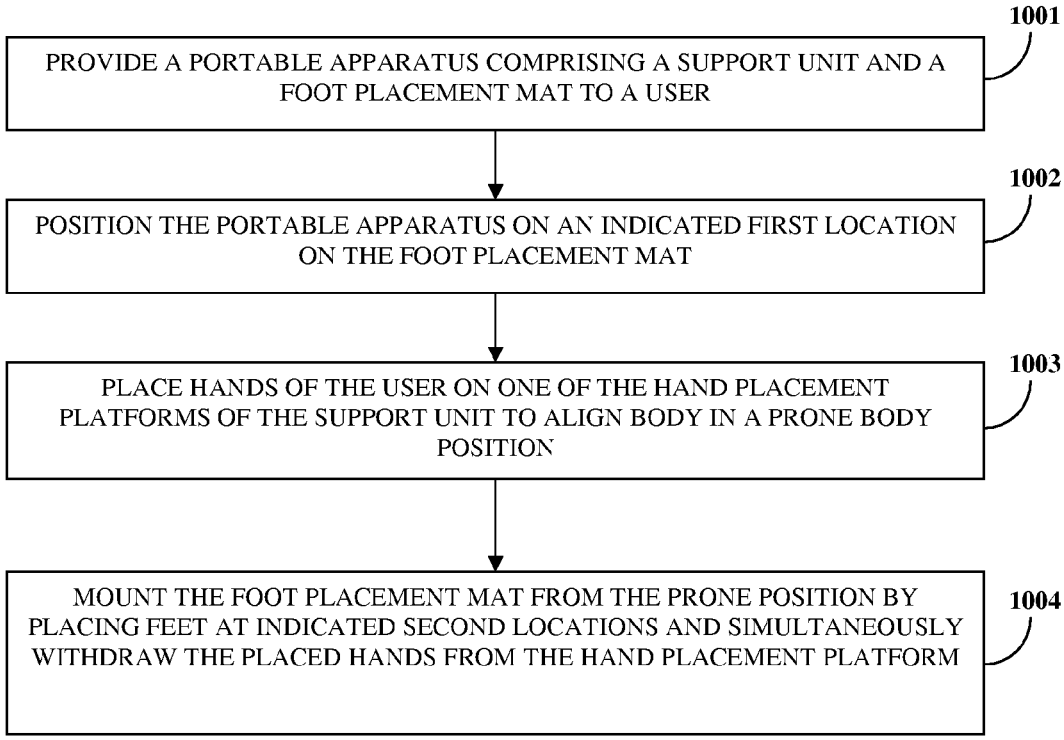
FIG. 10 illustrates a method of training a user in increasing levels of skill, control and maneuverability of a board for a board sport using the portable apparatus.

FIG. 10 illustrates a method of training a user in increasing levels of skill, control and maneuverability of a board for a board sport using the portable apparatus disclosed herein. A portable apparatus for practicing the board mounting techniques is provided 1001 to a user. The portable apparatus comprises a foot placement mat and a support unit as explained in the detailed description of FIG. 1.

The user positions 1002 the support unit on the indicated first location on the foot placement mat. The user positions the elongated section or the lower protruding section of the laterally opposite support members in a parallel direction or a perpendicular direction on the foot placement mat based on the user's training requirements, the user's experience, the user's skill, the user's comfort level, etc. The user places 1003 his hands on one of the hand placement platforms in the elevated position or the lower position, to align the user's body in a prone body position. The user then mounts 1004 the foot placement mat from the prone position by placing his feet at the indicated second locations and simultaneously withdraws his hands from the hand placement platform. To practice the board mounting technique, the user repeatedly mounts the foot placement mat from the prone position and simultaneously withdraws the his hands from the hand placement platforms. The user may bend and straighten the user's elbows in the prone position, a move similar to a pushup exercise prior to mounting the foot placement mat.

Figure 11A:
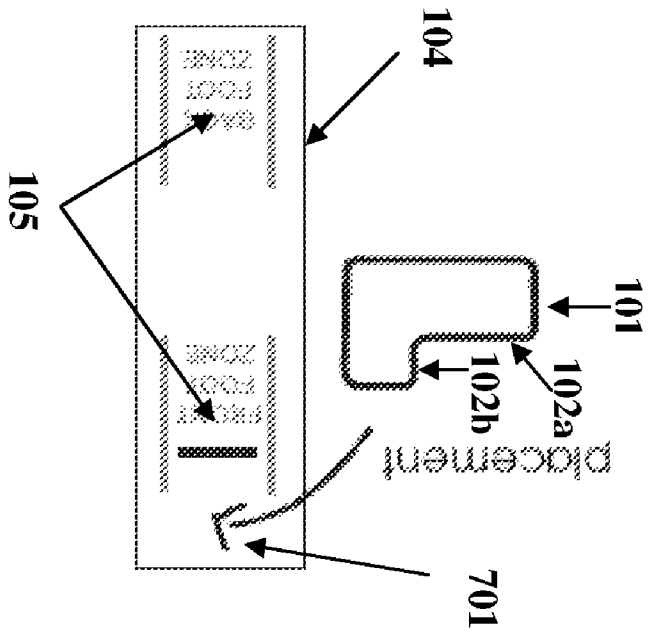
FIGS. 11A-11F exemplarily illustrate a user using the support unit positioned on the foot placement mat for training in a beginner's level.
Figure 11B:
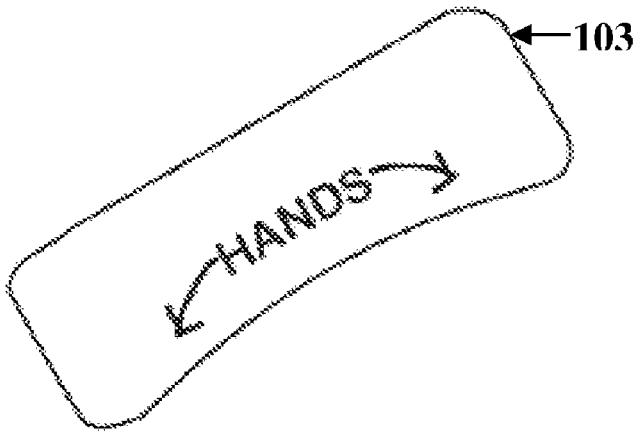
Figure 11C:
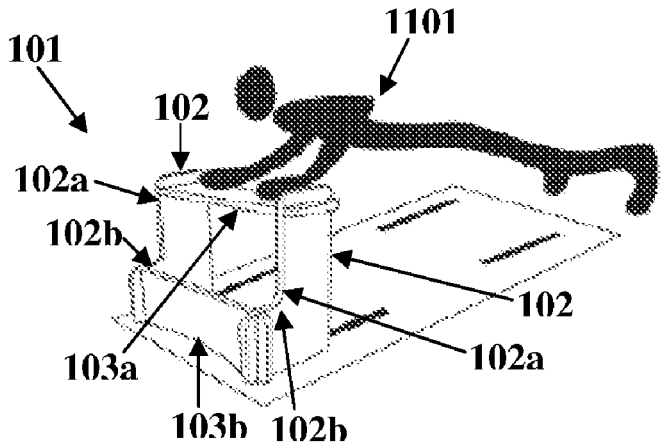

FIGS. 11A-11F exemplarily illustrate a user 1101 using the support unit 101 positioned on the foot placement mat 104 for training at a beginner's level. The support unit 101 is first positioned at the indicated first location 701 on the foot placement mat 104. The user 1101 positions the elongated section 102*a* of the laterally opposite support members 102 perpendicular to the foot placement mat 104 and positions the lower protruding section 102*b* of the laterally opposite support members 102 parallel to the foot placement mat 104 as illustrated in FIG. 11A. The user 1101 then places his hands with the user's 1101 arms bent at the elbows on the indicated location on the hand placement platform 103*a*, as illustrated in FIG. 11B. The hand placement platform 103*a* is detachably attached to the elongated section 102*a* of the laterally opposite support members 102 as illustrated in FIG. 11C.

Figure 11D:
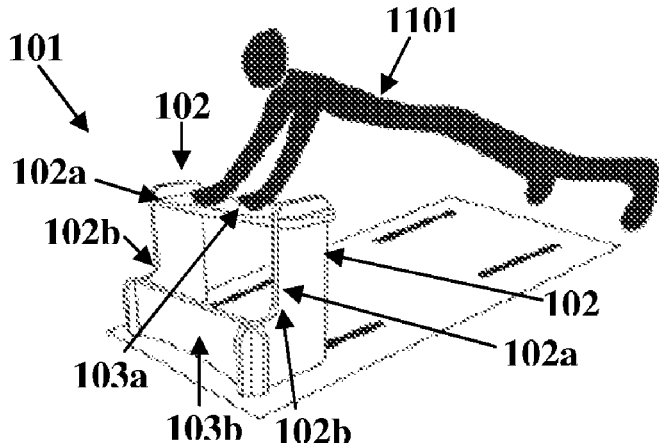
Figure 11E:
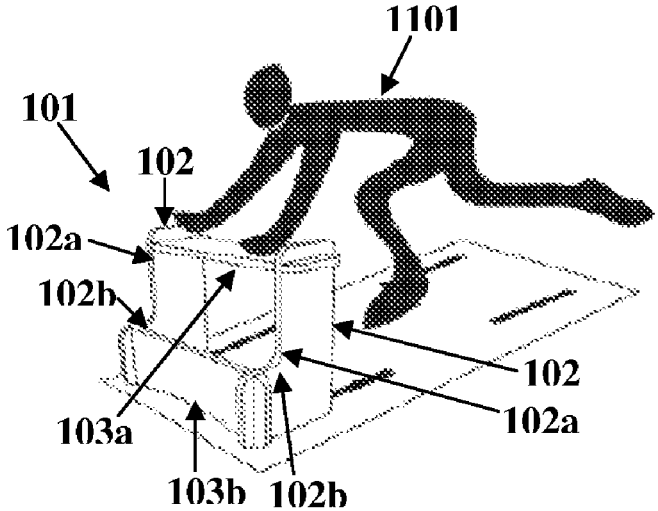
Figure 11F:
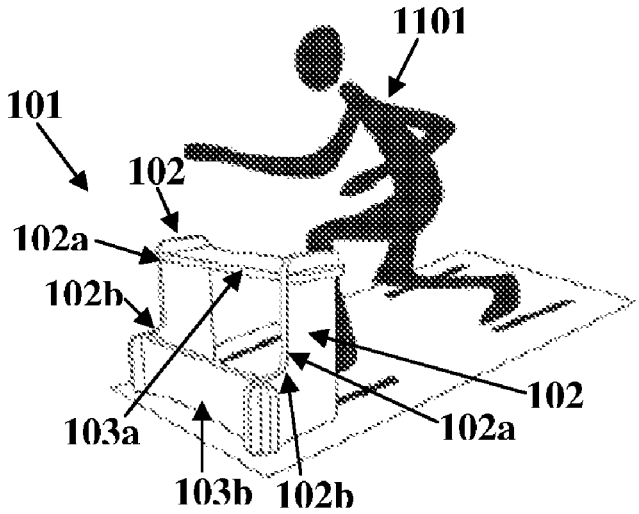

The user 1101 then gradually straightens the bent arms with the hands placed on the hand placement platform 103*a* as illustrated in FIG. 11D. The user 1101 then instantly mounts the foot placement mat 104 as illustrated in FIG. 11E. The user 1101 places the front foot at the "Front Foot Zone" indicated on the foot placement mat 104, places the back foot at the "Back Foot Zone" indicated on the foot placement mat 104, and withdraws his hands from the hand placement platform 103*a* as illustrated in FIG. 11F to mount the foot placement mat 104. The user 1101 then maintains a predefined body alignment and standing maneuver on the foot placement mat 104 corresponding to the board mounting techniques with his feet placed at the indicated second locations 105, knees bent, and the body aligned corresponding to a board sport.

Figure 12A:
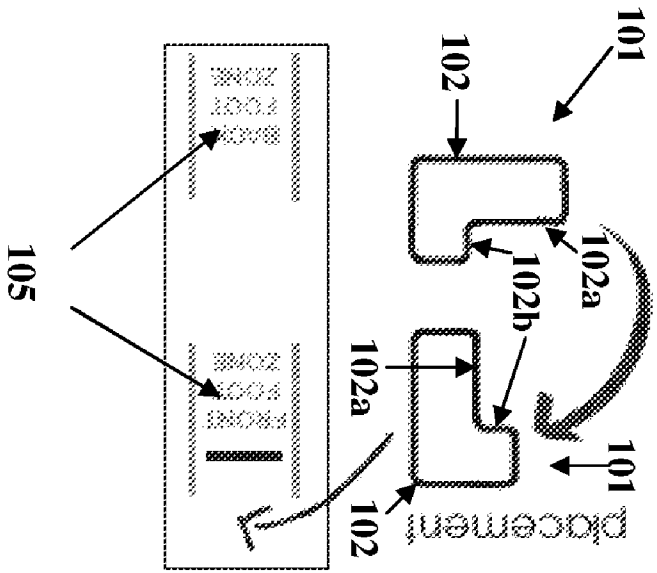
FIGS. 12A-12F exemplarily illustrate a user using the support unit positioned on the foot placement mat for training at an advanced level.
Figure 12B:
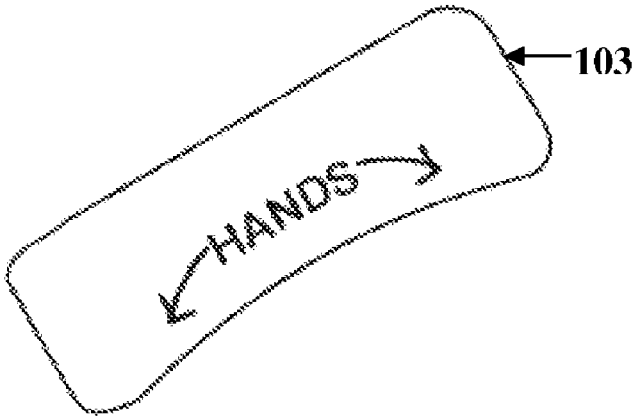
Figure 12C:
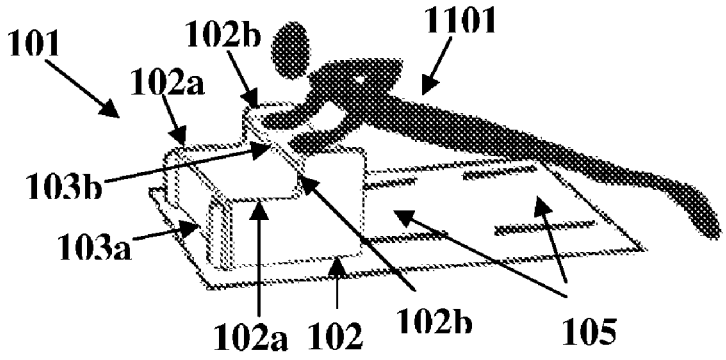

FIGS. 12A-12F exemplarily illustrate a user 1101 using the support unit 101 positioned on the foot placement mat 104 for training at an advanced level. The support unit 101 is first positioned at the indicated first location 701 on the foot placement mat 104. The user 1101 positions the elongated section 102*a* of the laterally opposite support members 102 parallel to the foot placement mat 104 and positions the lower protruding section 102*b* of the laterally opposite support members 102 perpendicular to the foot placement mat 104 as illustrated in FIG. 12A. The user 1101 then places his hands with the user's 1101 arms bent at the elbows on the hand placement platform 103*b*, as illustrated in FIG. 12B. The hand placement platform 103*b* is detachably attached to the lower protruding section 102*b* of the laterally opposite support members 102 as illustrated in FIG. 12C.

Figure 12D:
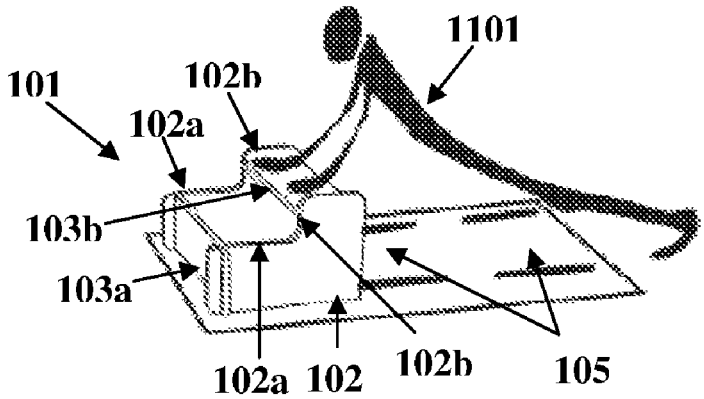
Figure 12E:
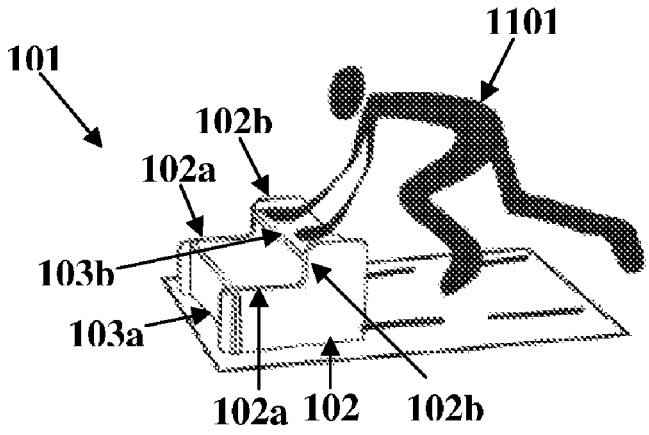
Figure 12F:
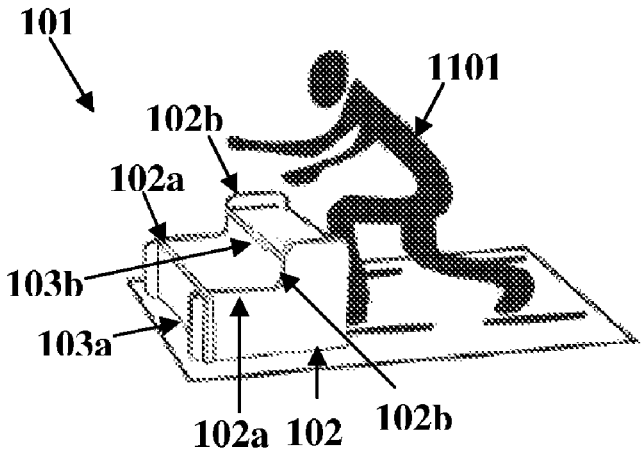

The user 1101 then gradually straightens the bent arms with the hands placed on the hand placement platform 103*b* as illustrated in FIG. 12D. The user 1101 then positions his feet on the foot placement mat 104 as illustrated in FIG. 12E. The user 1101 then places his front foot at the "Front Foot Zone" indicated on the foot placement mat 104, places the back foot at the "Back Foot Zone" indicated on the foot placement mat 104, and withdraws his 1101 hands from the hand placement platform 103*b* as illustrated in FIG. 12F. The user 1101 then maintains a predefined body alignment and standing maneuver on the foot placement mat 104 corresponding to board mounting techniques with feet placed in the indicated second locations 105, knees bent, and the body aligned corresponding to the board sport.

The foregoing examples have been provided merely for the purpose of explanation and are in no way to be construed as limiting of the present invention. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

We claim:

1. A method of training a user in increasing levels of skill, control and maneuverability of a board for a board sport, comprising the steps of:

providing a portable apparatus to said user, wherein said portable apparatus comprises:

a foot placement mat comprising a plurality of placement zones, wherein said placement zones indicate a first location for positioning a support unit and second locations for placing feet of said user;

said support unit comprising:

laterally opposite support members, wherein each of said laterally opposite support members comprises an elongated section and a lower protruding section for supporting opposite ends of a plurality of hand placement platforms; and said hand placement platforms detachably attached to said elongated section and said lower protruding section of the laterally opposite support members for enabling placement of hands of the user in an elevated position and a lower position respectively;

positioning the portable apparatus on said indicated first location on the foot placement mat;

placing hands of the user on one of the hand placement platforms detachably attached to one of the elongated section and the lower protruding section of the laterally opposite support members in one of said elevated position and said lower position, to align body of the user in a prone body position; and mounting the foot placement mat from said prone position by placing said feet at said indicated second locations and simultaneously withdrawing said placed hands from said hand placement platform.

2. The method of claim 1, wherein the elongated section of the laterally opposite support members is positioned perpendicular to the foot placement mat and the lower protruding section of the laterally opposite support members is positioned parallel to the foot placement mat for enabling the user to place hands of the user on one of the hand placement platforms in the elevated position for training in one of the difficulty levels of the board sport.

3. The method of claim 1, wherein the elongated section of the laterally opposite support members is positioned parallel to the foot placement mat and the lower protruding section of the laterally opposite support members is positioned perpendicular to the foot placement mat for enabling the user to place hands of the user on one of the hand placement platforms in the lower position for training in one of the difficulty levels of the board sport.

4. The method of claim 1, further comprising the step of repeating said simultaneous mounting the foot placement mat from the prone position and withdrawing the placed hands from the hand placement platforms by the user for practicing board mounting techniques of said board sport.

5. The method of claim 1, wherein the user positions the elongation section and the lower protruding section of the laterally opposite support members in one of a parallel direction and a perpendicular direction on the foot placement mat based on training requirements of the user, experience of the user, skill of the user, and comfort level of the user.

6. The method of claim 1, wherein the hand placement platforms comprise a contoured profile for resting shin of the user on said mounting of the foot placement mat by the user at the indicated second locations.

7. The method of claim 1, the support unit houses toes of the feet of the user on said mounting at the indicated second locations on the foot placement mat by the user.

* * * * *